US008162389B2

(12) United States Patent
Cohen

(10) Patent No.: US 8,162,389 B2
(45) Date of Patent: Apr. 24, 2012

(54) LOCKING MECHANISM FOR A FOLDING CHAIR

(75) Inventor: Ronald B. Cohen, Hopkinton, MA (US)

(73) Assignee: New Products LLC, Westborough, MA (US)

( * ) Notice: Subject to any disclaimer, the term of this patent is extended or adjusted under 35 U.S.C. 154(b) by 0 days.

(21) Appl. No.: 11/332,528

(22) Filed: Jan. 12, 2006

(65) Prior Publication Data

US 2007/0029846 A1 Feb. 8, 2007

Related U.S. Application Data

(60) Provisional application No. 60/701,548, filed on Jul. 22, 2005.

(51) Int. Cl.
*A47C 4/00* (2006.01)

(52) U.S. Cl. ..... 297/16.1; 297/55; 297/58

(58) Field of Classification Search ..... 297/16.1, 297/332, 331, 55, 452.55, 452.14, 58
See application file for complete search history.

(56) References Cited

U.S. PATENT DOCUMENTS 3,319,997 A * 5/1967 Clement ..... 297/16.1
3,429,611 A * 2/1969 Van Ryn ..... 297/58
3,851,920 A * 12/1974 Harris et al. ..... 297/452.55
4,265,483 A * 5/1981 Raftery et al. ..... 297/440.23
4,781,411 A * 11/1988 Kolb ..... 297/184.15
4,938,603 A 7/1990 Turner et al.
5,054,848 A 10/1991 Liu
5,529,270 A * 6/1996 Liu ..... 248/188
5,707,105 A 1/1998 Liu
5,954,391 A * 9/1999 Gray ..... 297/58
6,095,596 A * 8/2000 Chen ..... 297/39
6,206,462 B1 3/2001 Huang
6,595,582 B1 * 7/2003 Liu ..... 297/35
6,827,395 B1 12/2004 Wang et al.

* cited by examiner

*Primary Examiner* — David Dunn
*Assistant Examiner* — Erika Garrett
(74) *Attorney, Agent, or Firm* — Iandiorio Teska & Coleman, LLP

(57) ABSTRACT

A folding chair including a seat frame, a leg frame hinged to the seat frame, a hinge mechanism between the seat frame and the leg frame, a quick-release locking mechanism for releasably locking the seat frame with respect to the leg frame, and a supplemental locking mechanism including an orifice in one of the seat frame and the leg frame, an opening in the hinge mechanism aligned with the orifice when the chair is unfolded, and a fastener extending through the opening in the hinge mechanism and into the orifice to secure the seat frame to the leg frame.

19 Claims, 10 Drawing Sheets

LOCKING MECHANISM FOR A FOLDING CHAIR

RELATED APPLICATIONS

This application claims benefit of U.S. Provisional Application Ser. No. 60/701,548 filed Jul. 22, 2005, incorporated by reference herein.

FIELD OF THE INVENTION

This invention relates generally to a locking mechanism for a folding chair and more particularly to an improved locking mechanism for a folding chair for children.

BACKGROUND OF THE INVENTION

Locking mechanisms for children's folding chairs are designed to secure the chair in the open or deployed position. One such quick-release type locking mechanism includes a slideable spring-loaded post disposed in the seat frame which engages an opening in the hinge mechanism of the chair. To unlock the chair for folding, a lever connected to the slideable post is pressed to release the post from the opening in the hinge mechanism.

However, this particular locking mechanism can easily fail when a child sits or moves on the chair and/or inadvertently presses the release lever causing the chair to collapse unexpectedly. A child's fingers can become caught or entrapped in the hinge area of the chair resulting in severe lacerations and even finger tip amputations. To date, there have been seven reports of severe lacerations to children's fingers and four reported finger tip amputations. The U.S. Consumer Product Safety Commission (C.S.P.C.), in cooperation with Atico® International USA Inc., recently announced a voluntary recall of about 1.5 million children's chair having these conventional locking mechanisms. The C.S.P.C. announced that consumers should stop using recalled products immediately unless otherwise instructed. Accordingly, the locking mechanism does not, in fact, reliably secure the folding chair in the deployed position. Other locking mechanisms may suffer from the same problem.

SUMMARY OF THE INVENTION

It is therefore an object of this invention to provide an improved locking mechanism for a folding chair.

It is a further object of this invention to provide such a locking mechanism which is safer.

It is a further object of this invention to provide such a locking mechanism which prevents accidental folding of the chair.

It is a further object of this invention to provide such a locking mechanism which prevents injury.

It is a further object of this invention to provide such a locking mechanism which is more reliable.

It is a further object of this invention to provide such a locking mechanism which cannot be defeated by children.

This invention results from the realization that for folding chairs with a quick-release type lock, safety is improved if a supplemental lock is added in the form of an orifice in the seat frame, an opening in the hinge mechanism alignable with the orifice, and a fastener extending through the opening in the hinge mechanism and into the orifice to more reliably secure the seat frame in the deployed position.

The subject invention, however, in other embodiments, need not achieve all these objectives and the claims hereof should not be limited to structures or methods capable of achieving these objectives.

This invention features a folding chair includes a seat frame, a leg frame hinged to the seat frame, a hinge mechanism between the seat frame and the leg frame, a quick-release locking mechanism for releasably locking the seat frame with respect to the leg frame, and a supplemental locking mechanism including an orifice in one of the seat frame and the leg frame, an opening in the hinge mechanism aligned with the orifice when the chair is unfolded, and a fastener extending through the opening in the hinge mechanism and into the orifice to secure the seat frame to the leg frame.

In one embodiment, the orifice may include internal threads and the fastener may be a machine screw. The folding chair may further include a tool for threading the screw into the threaded orifice. The hinge mechanism may include a recess. The locking mechanism may include a post connected to one of the seat frame and the leg frame engageable with the recess for locking the seat frame in relation to the leg frame. The orifice may be in the seat frame or in the leg frame. The leg frame may include a rear leg and a front leg. The rear leg frame may be connected to the front leg. The rear leg may include two parallel tubes and a cross bar. The front leg may be U-shaped. The front leg may include a cross bar. The hinge mechanism may be connected between the rear leg and the seat frame. The hinge mechanism may be connected between the front leg and the seat frame. The post may be connected to the seat frame or to the leg frame. The quick-release locking mechanism may includes a second hinge mechanism connected between the seat frame and the leg frame having an opening therein and a slideable post connected through the seat frame engageable with the opening in the second hinge mechanism for locking the seat frame in relation to the leg frame. The slideable post may be pivotally attached to a handle. The second hinge mechanism may include a recess. A second post may be connected to one of the leg frame and the seat frame engageable with the recess in the second hinge mechanism for locking the seat frame in relation to the leg frame.

This invention also features a folding chair for children including a seat frame, a leg frame hinged to the seat frame, a hinge mechanism between the seat frame and the leg frame, and a locking mechanism including an orifice in one of the seat frame and the leg frame, an opening in the hinge mechanism aligned with the orifice when the chair is unfolded, and a fastener extending through the opening in the hinge mechanism and into the orifice to secure the seat frame with respect to the leg frame.

In a preferred embodiment, the orifice may include internal threads and the fastener is a machine screw. The folding chair may further include a tool for threading the screw into the threaded orifice. The hinge mechanism may include a recess. The locking mechanism may include a second post connected to one of the seat frame and the leg frame engageable with the recess for locking the seat frame in relation to the leg frame.

This invention further features a folding chair including a seat frame, a leg frame hinged to the seat frame, a hinge mechanism between the seat frame and the leg frame, a quick-release locking mechanism for releasably locking the seat frame with respect to the leg frame, and a supplemental locking mechanism including an orifice in the seat frame, an opening in the hinge mechanism aligned with the orifice when the chair is unfolded, and a fastener extending through the opening in the hinge mechanism and into the orifice to secure the seat frame to the leg frame.

In a preferred embodiment, the orifice may include internal threads and the fastener may be a machine screw. The folding chair may further include a tool for threading the screw into the threaded orifice.

BRIEF DESCRIPTION OF THE DRAWINGS

Other objects, features and advantages will occur to those skilled in the art from the following description of a preferred embodiment and the accompanying drawings, in which.

PREFERRED EMBODIMENT

Figure 1:
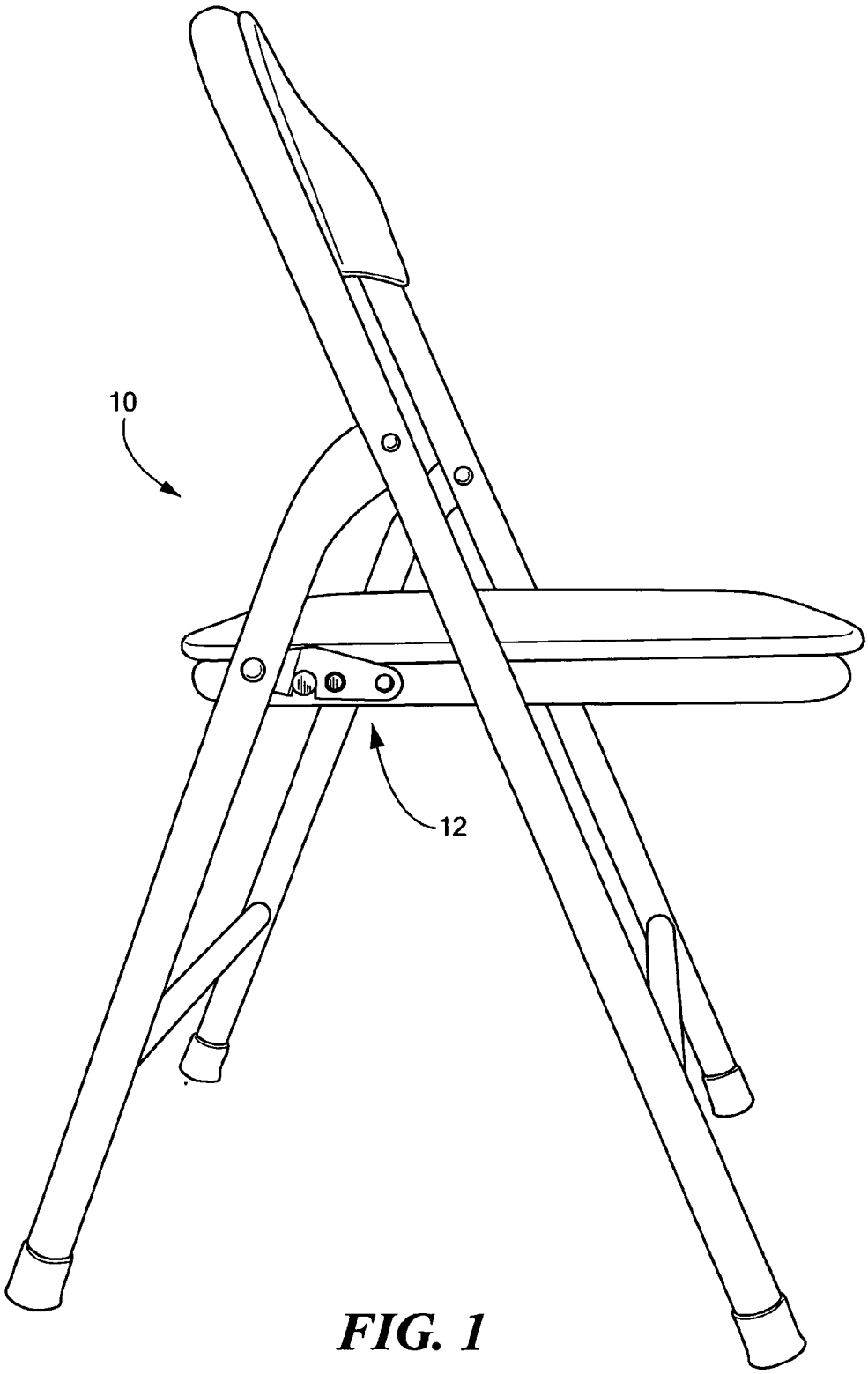
FIG. 1 PRIOR ART
FIG. 1 is a schematic three-dimensional side view of a children's folding chair with a quick-release type locking mechanism.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
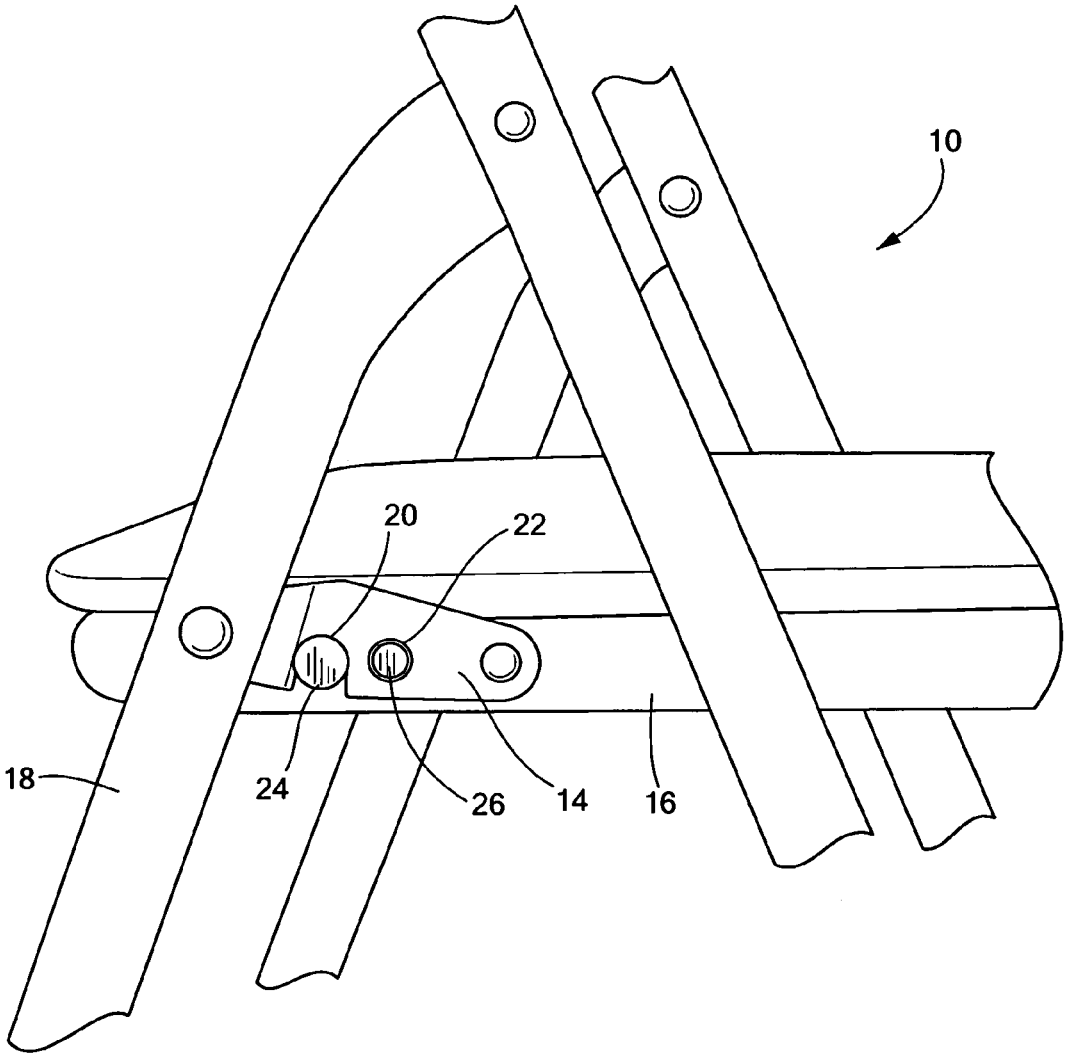
FIG. 2 PRIOR ART
FIG. 2 is a schematic three-dimensional side view showing in further detail the components of the quick-release locking mechanism shown in FIG. 1.
Figure 3:
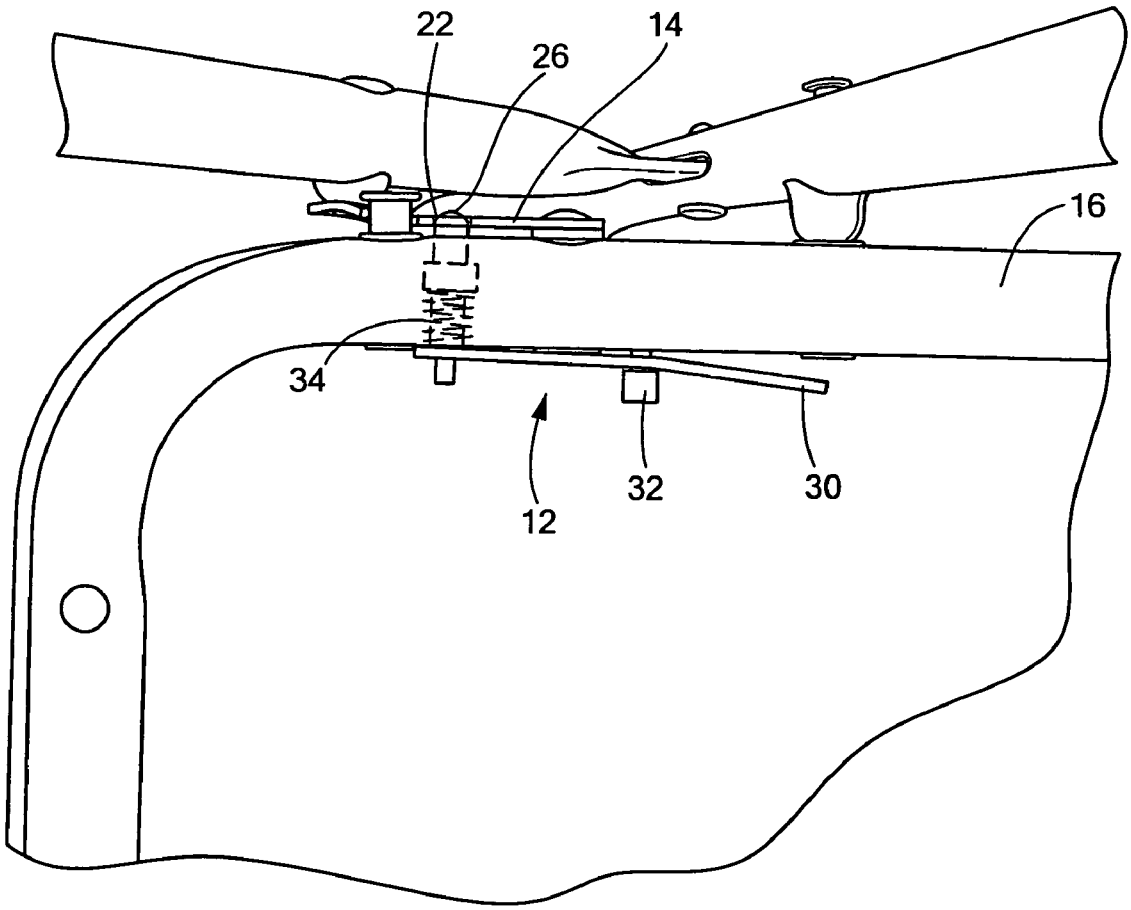
FIG. 3 PRIOR ART
FIG. 3 is a schematic three-dimensional bottom view showing a lever of the quick-release locking mechanism shown in FIG. 2.
Figure 4:
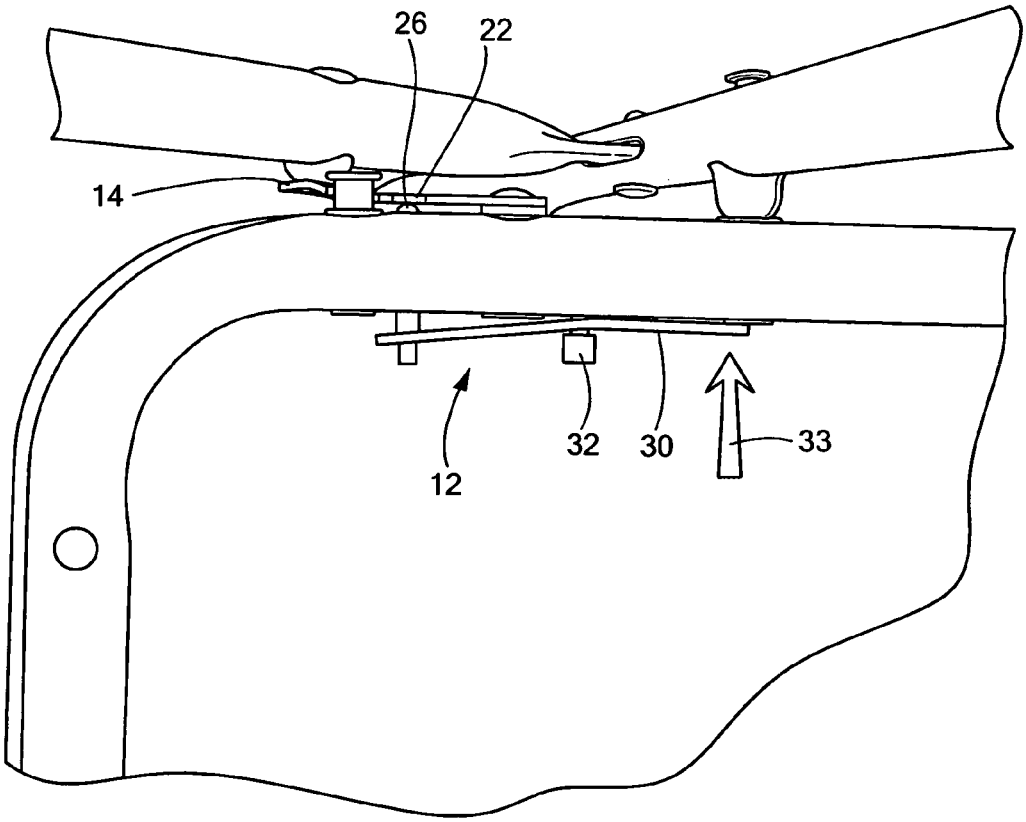
FIG. 4 PRIOR ART
FIG. 4 is a schematic three-dimensional bottom view showing the lever shown in FIG. 3 depressed to unlock the chair shown in FIG. 1.
Figure 5:
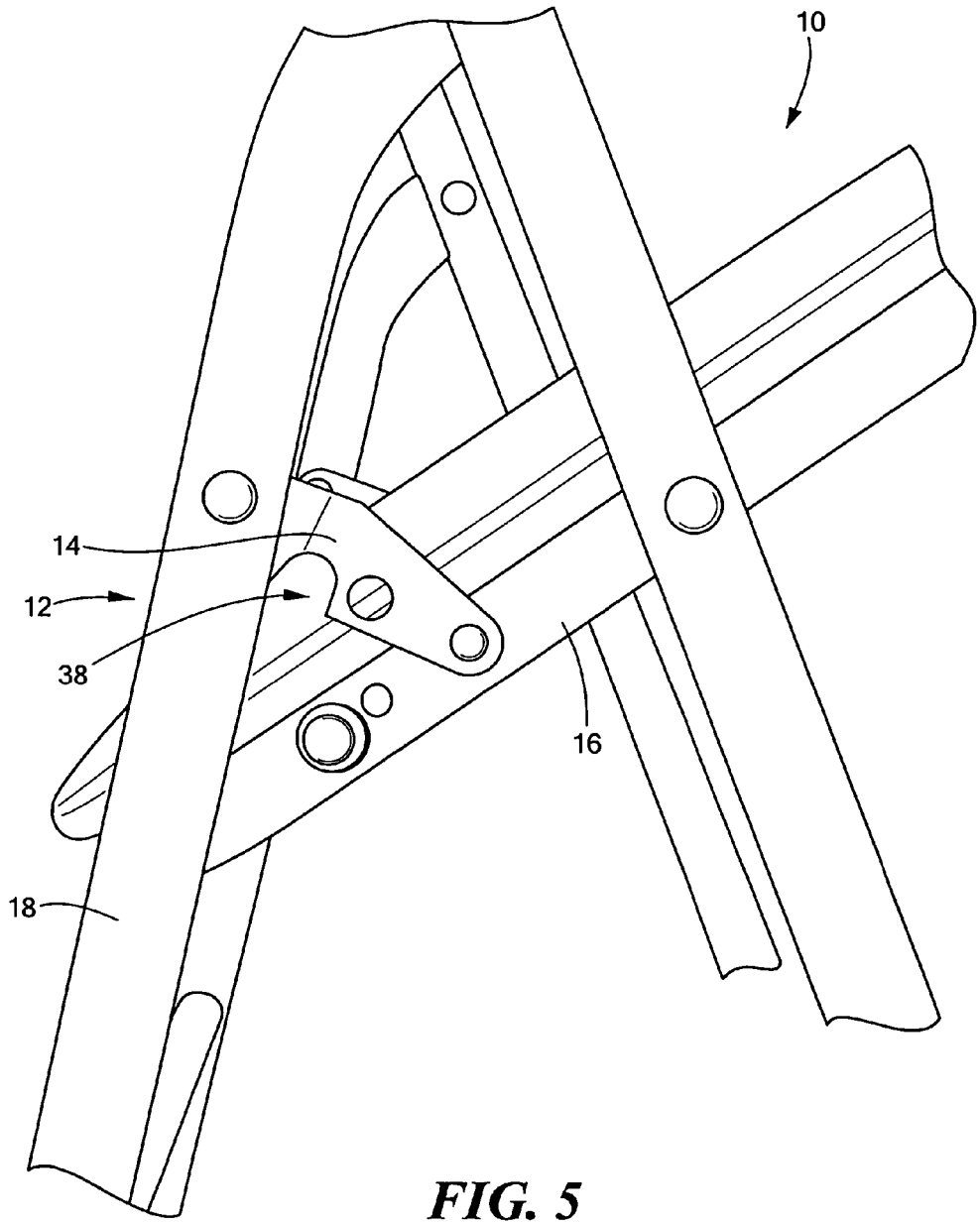
FIG. 5 PRIOR ART
FIG. 5 is a schematic three-dimensional side view of the folding chair shown in FIG. 1 in a partially folded position.

As discussed in the Background section above, typical quick-release type locking mechanisms for children's folding chairs can easily fail resulting in serious injury to children. For example, prior art chair 10, FIG. 1 includes quick-release locking mechanism 12 that includes hinge 14, FIG. 2 connected between seat frame 16 and leg frame 18. Hinge mechanism 14 includes recess 20 and opening 22. Post 24 is typically attached to seat frame 16 and engages recess 20. Slideable post 26 is typically disposed through seat frame 16, as shown in phantom in FIG. 3, and engages orifice 22 in hinge mechanism 14. Spring 34 is typically disposed about slideable post 26 and biases slideable post 26 into engagement with recess 22. Lever 30 is attached to slideable post 26 and pivots on pivot screw 32 to provide a quick-release of slideable post 26 from opening 22, thus allowing chair 10 to be folded. FIG. 4 shows an example of lever 30 depressed, indicated by arrow 33, to disengage slideable post 26 from opening 22 in hinge mechanism 14. Chair 10 can then be folded, as shown in the partially-folded position in FIG. 5. However, as discussed in the Background section above, chair 10 with quick-release type locking mechanism 12 can easily collapse when a child sits or moves on chair 10, or inadvertently presses lever 30, resulting in children's fingers being caught or trapped in area 38 between hinge mechanism 14, leg frame 18, and seat frame 16. The result can be severe lacerations and fingertip amputations.

Figure 6:
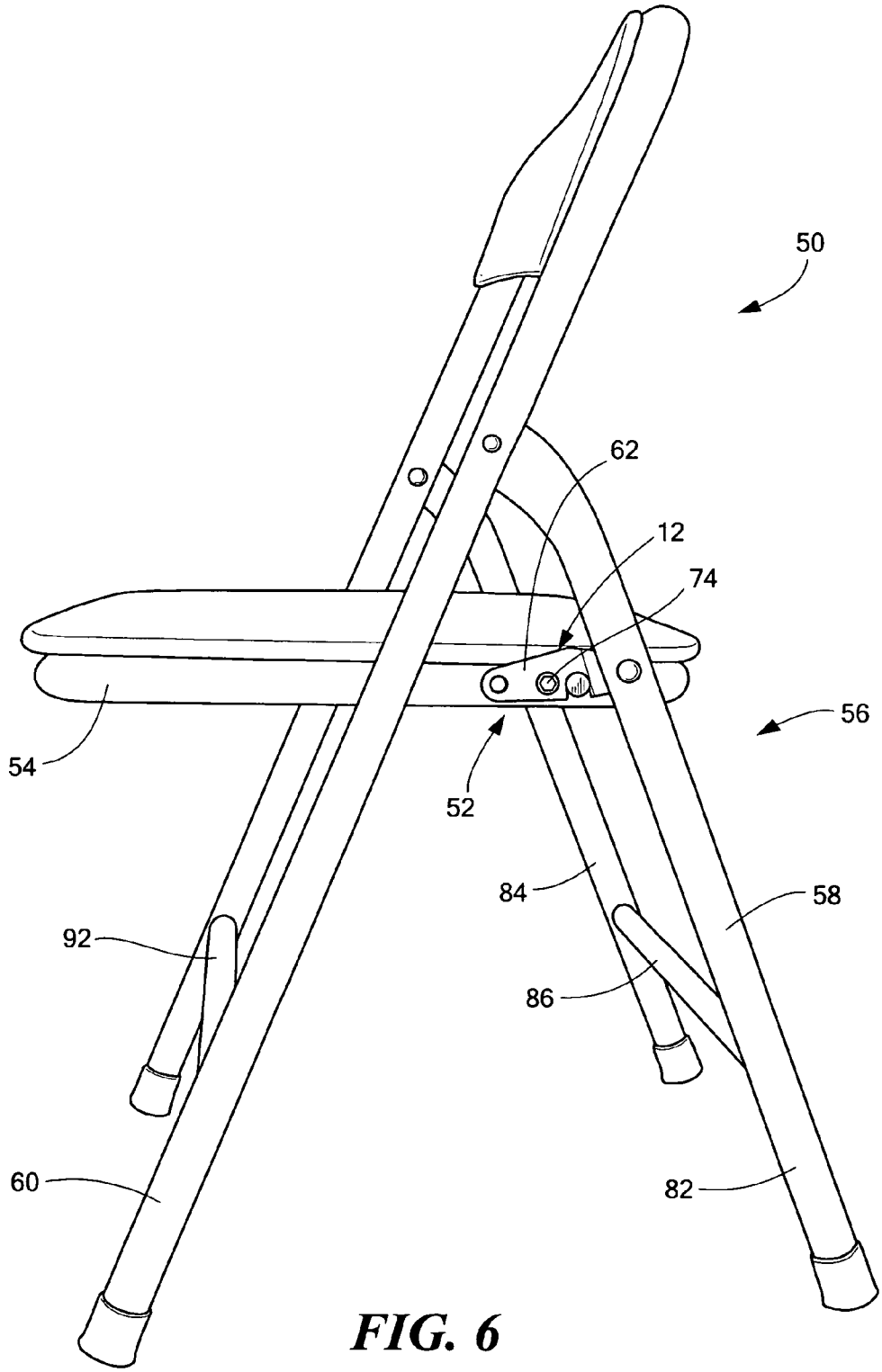
FIG. 6 is a schematic three-dimensional side view of one embodiment of a folding chair with an improved locking mechanism of this invention.

In contrast, folding chair 50, FIG. 6 of this invention with improved locking mechanism 52 includes seat frame 54 and leg frame 56 hinged to seat frame 54 by hinge mechanism 62. Leg frame 56 typically includes rear leg 58 connected to front leg 60. Preferably, rear leg 56 includes two parallel tubes 82 and 84 connected with cross bar 86. Front leg frame 60 is typically U-shaped and includes crossbar 92.

Figure 7:
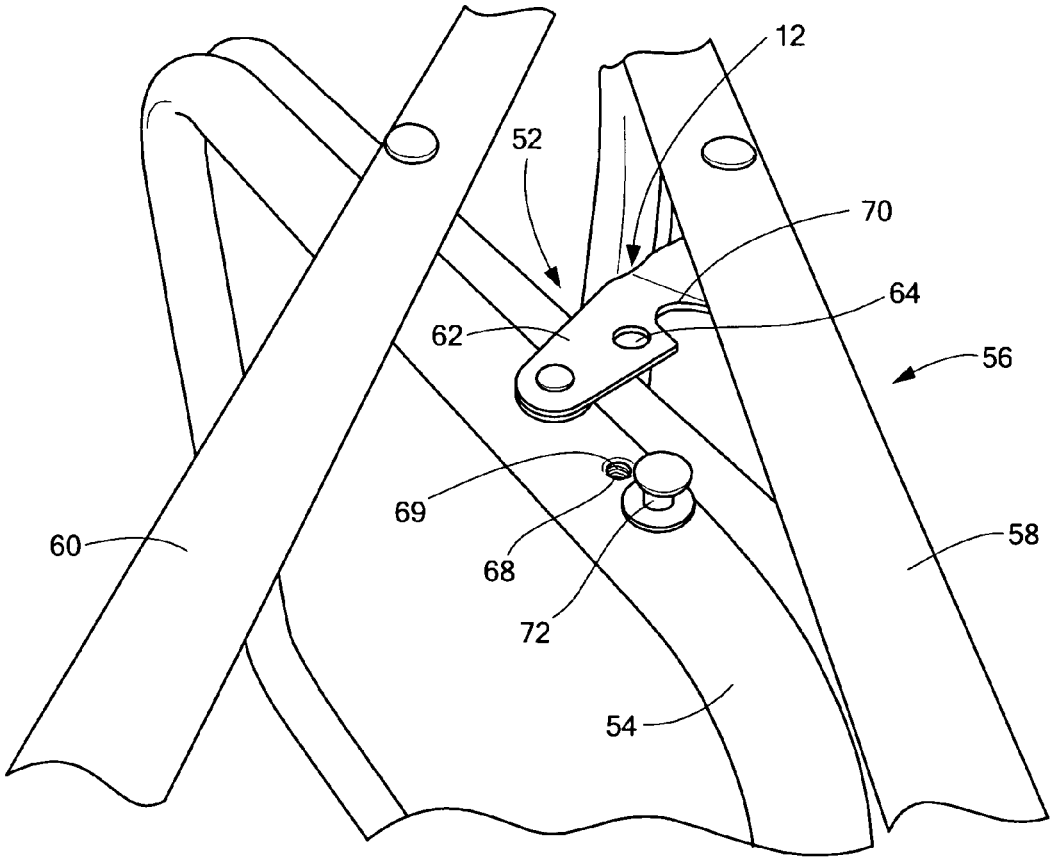
FIG. 7 is a schematic three-dimensional bottom-side view showing in further detail the components of the locking mechanism shown in FIG. 6.
Figure 8:
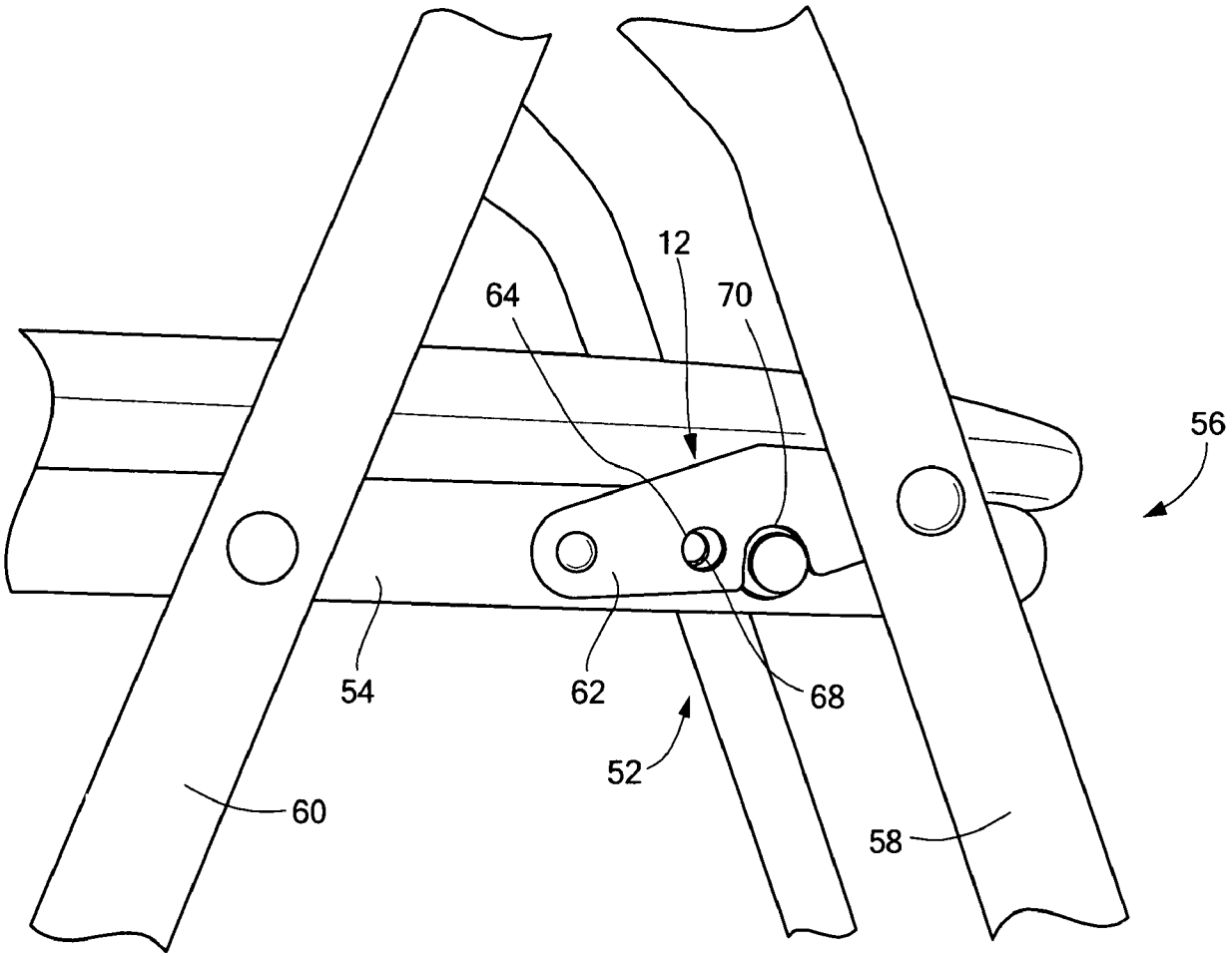
FIG. 8 is a schematic three-dimensional side view showing the opening in the hinge mechanism aligned with the orifice in the seat frame.
Figure 9:
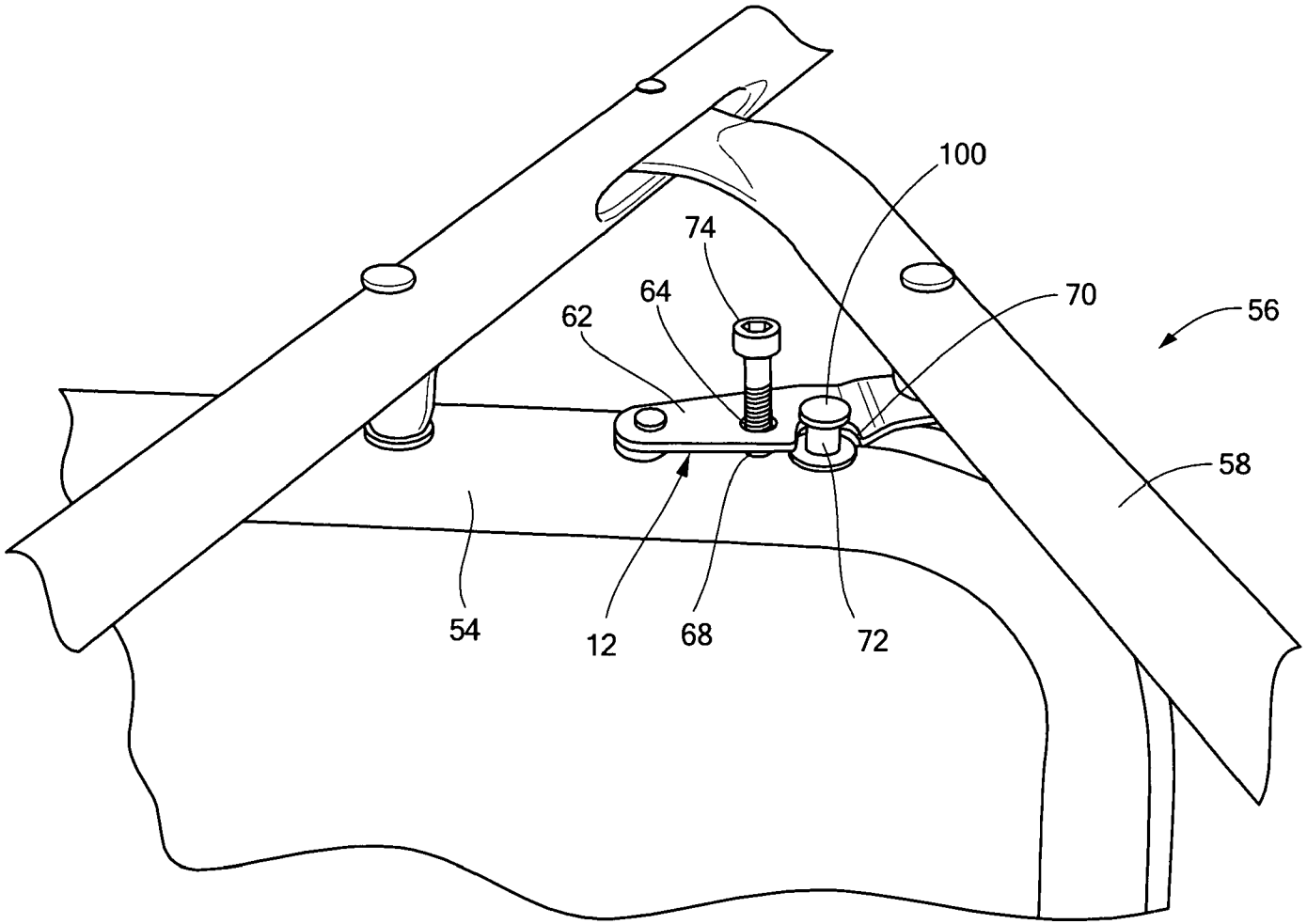
FIG. 9 is a schematic three-dimensional bottom-side view showing the locking mechanism shown in FIGS. 7-8 with a fastener extending through the opening in the hinge mechanism and into the orifice in the seat frame to secure the chair in an open or deployed position.
Figure 10:
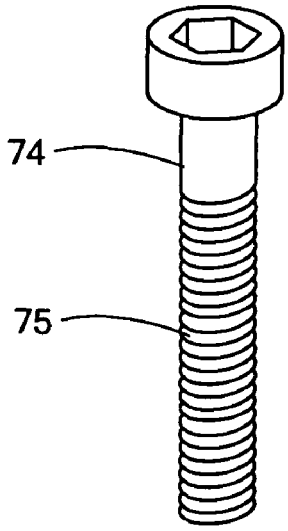
FIG. 10 is a schematic three-dimensional top view showing one example of the fastener shown in FIG. 9.
Figure 11:
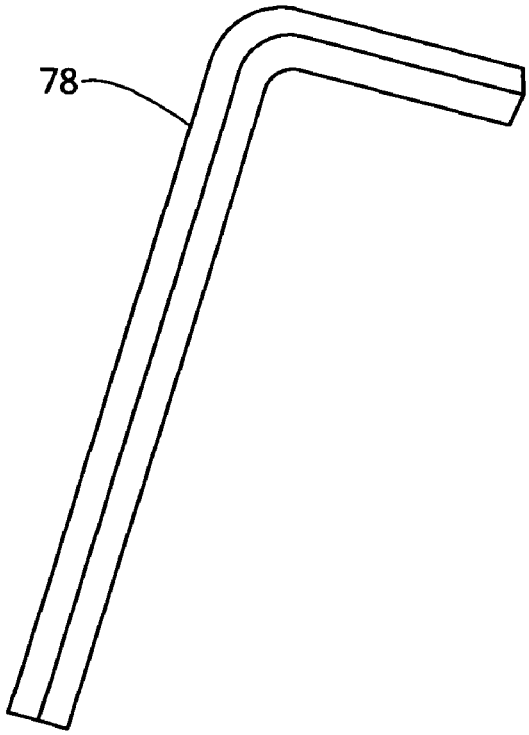
FIG. 11 is a schematic three-dimensional top view showing one example of a tool used to secure the fastener shown in FIG. 9 to the seat frame.

In a preferred embodiment, chair 50 includes quick-release type locking mechanism 12 described above in reference to FIGS. 1-5 that releasably locks seat frame 54, FIG. 6 with respect to leg frame 56. Chair 50 also includes supplemental locking mechanism 52 that includes orifice 68, FIG. 7, ideally in seat frame 54. Locking mechanism 52 includes opening 64 in hinge mechanism 62 that aligns with orifice 68 when chair 50 is unfolded, as shown in FIG. 8. Fastener 74, FIG. 9, e.g., a machine type screw, extends through opening 64 in hinge mechanism 62 into orifice 68 to secure seat frame 54 to leg frame 56. In a preferred design, orifice 68 includes internal threads 69, as shown in FIG. 7. Fastener or machine screw 74 with threads 75, FIG. 10 are threaded into internal threads 69, FIG. 7 in orifice 68 through opening 64 in hinge mechanism 62 as shown in FIG. 9. In a preferred embodiment a tool, such as hex wrench 78, FIG. 11 is used to thread fastener or screw 74, FIG. 9 into the orifice 68 with internal threads 69.

In one embodiment, hinge mechanism 62, FIG. 7, of quick-release mechanism 12, FIGS. 6-9, includes recess 70 that engages post 72, typically on seat frame 54, to further secure frame 54 in relation to leg frame 56, as shown in FIG. 8.

Chair 50 with locking mechanism 52 of this invention provides both a quick-release type locking mechanism to releasably lock the seat frame to the leg frame and an improved locking mechanism with a fastener that extends through opening in the hinge mechanism into the orifice in the seat frame to secure the chair in an unfolded open or deployed position. The result is chair 50 with improved locking mechanism 52 cannot accidentally collapse or fold when a child sits or moves on the chair or inadvertently presses the lever of the quick-release locking mechanism. Hence, chair 50 with locking mechanism 52 is more reliable and prevents accidental injury to children's fingers. Because the tool is used that can be hidden from children, locking mechanism 52 cannot be defeated by children.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A folding chair comprising:

a seat frame;

a leg frame hinged to the seat frame;

a first hinge mechanism on a first side of the chair between the seat frame and the leg frame;

a quick-release locking mechanism comprising a slideable spring loaded post on the first side of the chair for releasably locking the seat frame with respect to the leg frame;

a second hinge mechanism on a second side of the chair between the seat frame and the leg frame;

a separate supplemental locking mechanism on the second side of the chair including:

a previously formed internally threaded orifice in one of the seat frame and the leg frame on the second side of the chair configured to receive a threaded fastener, an opening in the second hinge mechanism aligned with the orifice when the chair is unfolded, and the threaded fastener configured to extend through the opening in the second hinge mechanism to engage the internally threaded orifice to secure the seat frame to the leg frame.

2. The folding chair of claim 1 in which the fastener is a machine screw.

3. The folding chair of claim 2 in which the screw includes a recess configured to receive a tool for threading the screw into the threaded orifice.

4. The folding chair of claim 1 in which the first hinge mechanism include a recess and an opening.

5. The folding chair of claim 4 in which the quick-release locking mechanism includes a post on the first side of the chair connected to one of the seat frame and the leg frame engageable with the recess and wherein the slideable post is connected through the seat frame on the first side of the chair and is engageable with the opening in the first hinge mechanism and for locking the seat frame in relation to the leg frame.

6. The folding chair of claim 5 in which the post is connected to the seat frame.

7. The folding chair of claim 5 in which the post is connected to the leg frame.

8. The folding chair of claim 5 in which the slideable post is pivotally attached to a handle.

9. The folding chair of claim 1 in which the orifice is in the seat frame.

10. The folding chair of claim 1 in which the orifice is in the leg frame.

11. The folding chair of claim 1 in which the leg frame includes a rear leg and a front leg.

12. The folding chair of claim 11 in which the rear leg frame is connected to the front leg.

13. The folding chair of claim 11 in which the rear leg includes two parallel tubes and a cross bar.

14. The folding chair of claim 11 in which the front leg is U-shaped.

15. The folding chair of claim 14 in which the front leg includes a cross bar.

16. The folding chair of claim 11 in which the hinge mechanism is connected between the rear leg and the seat frame.

17. The folding chair of claim 11 in which the hinge mechanism is connected between the front leg and the seat frame.

18. The folding chair of claim 1 in which the second hinge mechanism includes a recess.

19. The folding chair of claim 18 further including a second post on the second side of the chair connected to one of the leg frame and the seat frame engageable with the recess in the second hinge mechanism for locking the seat frame in relation to the leg frame.

* * * * *